US008893322B2

(12) United States Patent
Kanthasamy

(10) Patent No.: US 8,893,322 B2
(45) Date of Patent: Nov. 25, 2014

(54) SOFA THAT CONVERTS TO VARIOUS POSITIONS USING CLICK-CLACK MECHANISMS, INCLUDING CHAISE POSITION WITH TWO INDIVIDUAL CHAISES FACING ONE ANOTHER

(75) Inventor: Abedan Kanthasamy, Kuala Lumpur (MY)

(73) Assignee: Lifestyle Solutions, Inc., Fremont, CA (US)

( * ) Notice: Subject to any disclaimer, the term of this patent is extended or adjusted under 35 U.S.C. 154(b) by 407 days.

(21) Appl. No.: 13/117,218

(22) Filed: May 27, 2011

(65) Prior Publication Data

US 2012/0297535 A1 Nov. 29, 2012

(51) Int. Cl.

| | |
|---|---|
| ***A47C 17/17*** | (2006.01) |
| ***A47C 20/04*** | (2006.01) |
| ***A47C 17/16*** | (2006.01) |

(52) U.S. Cl.

CPC ..... *A47C 20/043* (2013.01); *A47C 17/162* (2013.01)

USPC ..... 5/12.1; 5/12.2

(58) Field of Classification Search

USPC ..... 5/12.1, 13, 17, 16, 27, 35, 12.2, 52, 2.1, 5/37.1, 43, 47; 297/44, 63, 232, 233, 297/350, 351, 353, 354.1, 445.1, 448.1, 297/448.2, 354.13, 356; D6/381

See application file for complete search history.

(56) References Cited

U.S. PATENT DOCUMENTS

| | | | | |
|---|---|---|---|---|
| 268,145 | A * | 11/1882 | Taylor | 5/37.1 |
| 5,327,591 | A | 7/1994 | Fireman et al. | |
| D446,962 | S * | 8/2001 | Mourgue | D6/381 |
| 7,922,253 | B2 | 4/2011 | Chen | |

* cited by examiner

*Primary Examiner* — Peter M Cuomo
*Assistant Examiner* — Brittany Wilson
(74) *Attorney, Agent, or Firm* — Jackson Walker L.L.P.

(57) ABSTRACT

A sofa configured to be converted into various positions, including a sofa, lounge, bed and chaise position. The sofa includes a seat deck and a backrest. Further, the sofa includes a first type of click-clack mechanisms placed between the seat deck and backrest which are used to convert the sofa to the lounge or bed position. Also, the sofa includes a second type of click-clack mechanisms placed throughout the seat deck and backrest. These are used to convert the sofa to one of two possible chaise positions. In particular, these click-clack mechanisms enable the sides of the seat deck and backrest to be raised to various levels (e.g., 20 degrees, 40 degrees). As a result, opposing sides of the seat deck and backrest can be raised at the appropriate level thereby providing two individual chaises facing one another.

14 Claims, 13 Drawing Sheets

SOFA THAT CONVERTS TO VARIOUS POSITIONS USING CLICK-CLACK MECHANISMS, INCLUDING CHAISE POSITION WITH TWO INDIVIDUAL CHAISES FACING ONE ANOTHER

TECHNICAL FIELD

The present invention relates to sofas, and more particularly to a sofa that can convert to various positions using click-clack mechanisms, including a chaise position with individual chaises facing one another.

BACKGROUND

A sofa is an upholstered item of furniture for the comfortable seating of more than one person and typically has an armrest on both sides of the sofa along with a back rest. Sofas are usually to be found in the family room, living room, den or the lounge. They are covered in a variety of textiles or in leather.

Sofas may be converted into a bed. This type of furniture is often referred to as a "sofa convertible." However, traditional beds though typically cannot be converted into other different positions, such as a chaise, which allows the user to stretch out their legs while having their back and neck supported.

Furthermore, traditional beds do not currently have the feature of converting into other positions, such as a chaise position, that would allow multiple individuals to face one another in opposite directions while at the same time stretch out their legs. In this manner, two individuals facing one another in opposite directions could converse with one another while at the same time stretch out their legs and relax.

BRIEF SUMMARY

In one embodiment of the present invention, a sofa comprises a seat deck and a backrest. The sofa further comprises a plurality of a first type of click-clack mechanisms placed between the seat deck and the backrest, where the first type of click-clack mechanisms are configured to convert the sofa to a lounge position or a bed position. Additionally, the sofa comprises a plurality of a second type of click-clack mechanisms placed throughout the seat deck and backrest, where the second type of click-clack mechanism are configured to convert the sofa to one of two possible chaise positions. The second type of click-clack mechanisms enable the sides of the seat deck and backrest to be raised to various levels.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE SEVERAL VIEWS OF THE DRAWINGS

A better understanding of the present invention can be obtained when the following detailed description is considered in conjunction with the following drawings, in which.

DETAILED DESCRIPTION

The present invention comprises a sofa configured to be converted into various positions, including a sofa, lounge, bed and chaise position. The sofa includes a seat deck and a backrest. Further, the sofa includes a first type of click-clack mechanisms placed between the seat deck and backrest which are used to convert the sofa to the lounge or bed position. Also, the sofa includes a second type of click-clack mechanisms placed throughout the seat deck and backrest. These are used to convert the sofa to one of two possible chaise positions. In particular, these click-clack mechanisms enable the sides of the seat deck and backrest to be raised to various levels (e.g., 20 degrees, 40 degrees). As a result, opposing sides of the seat deck and backrest can be raised at the appropriate level thereby providing two individual chaises facing one another.

It is to be understood that the following disclosure provides many different embodiments, or examples, for implementing different features of various embodiments. Specific examples of components and arrangements are described below to simplify the patent disclosure. These are, of course, merely examples and are not intended to be limiting.

As discussed in the Background section, sofas may be converted into a bed. This type of furniture is often referred to as a "sofa convertible." However, traditional beds though typically cannot be converted into other different positions, such as a chaise, which allows the user to stretch out their legs while having their back and neck supported. Furthermore, sofa beds do not currently have the feature of converting into other positions, such as a chaise position, that would allow multiple individuals to face one another in opposite directions while at the same time stretch out their legs. In this manner, two individuals facing one another in opposite directions could converse with one another while at the same time stretch out their legs and relax.

Figure 1:
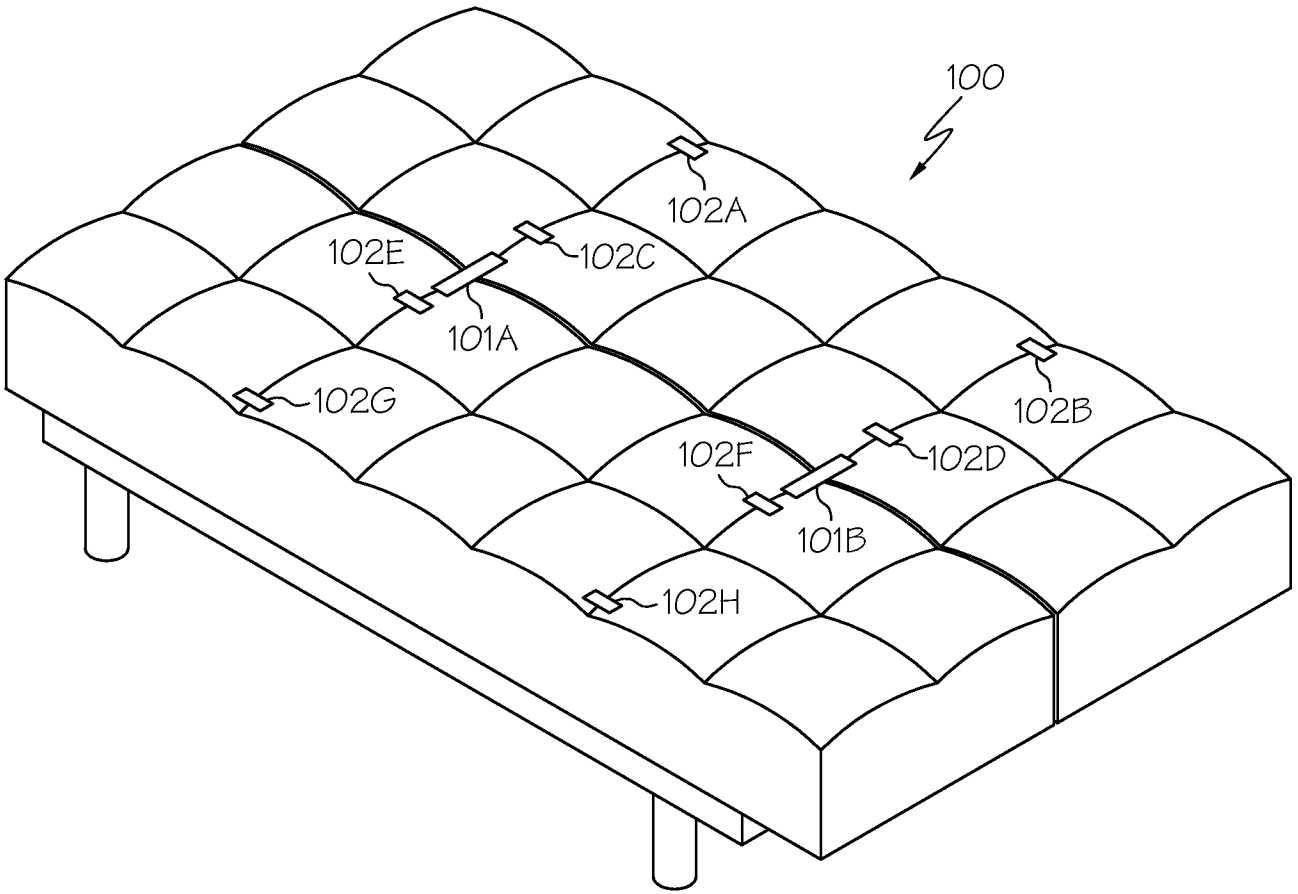
FIG. 1 illustrates the various locations of the hinges in the sofa used to convert the sofa to various positions in accordance with an embodiment of the present invention.
Figure 2:
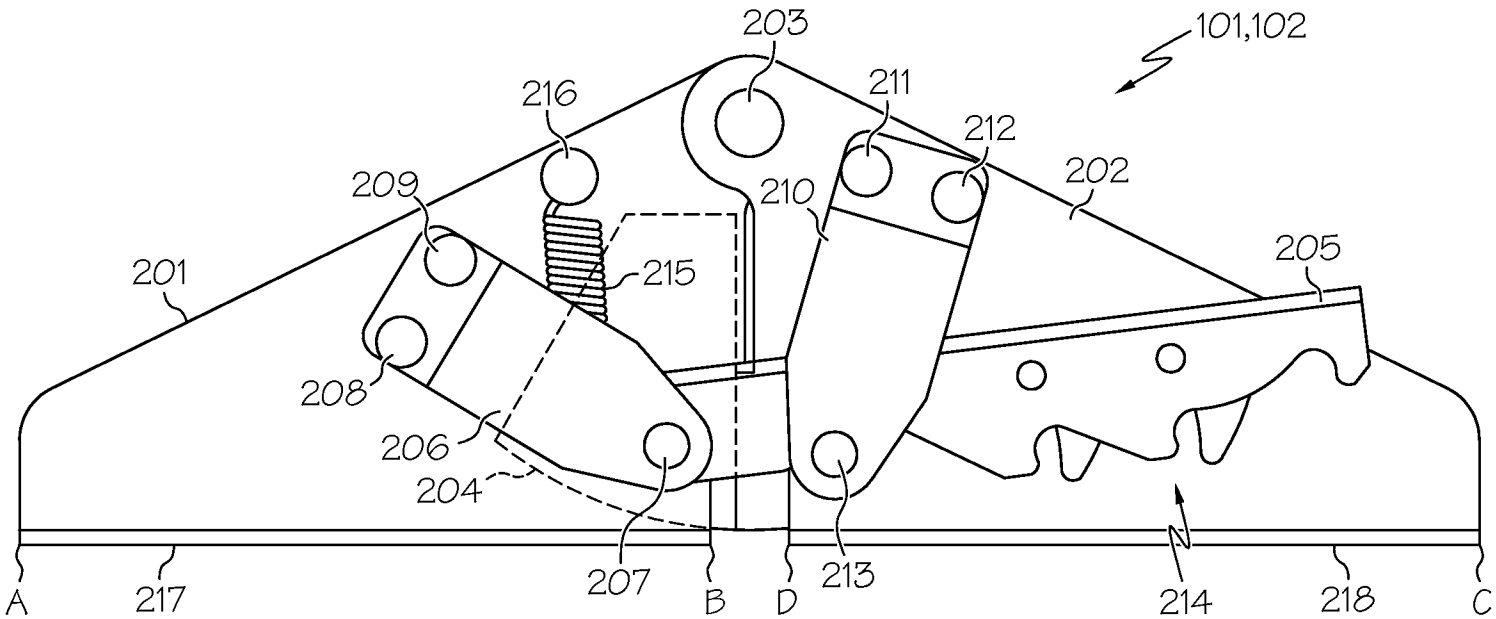
FIG. 2 is an elevation view of a click-clack mechanism used to convert the sofa to different positions in accordance with an embodiment of the present invention.
Figure 3:
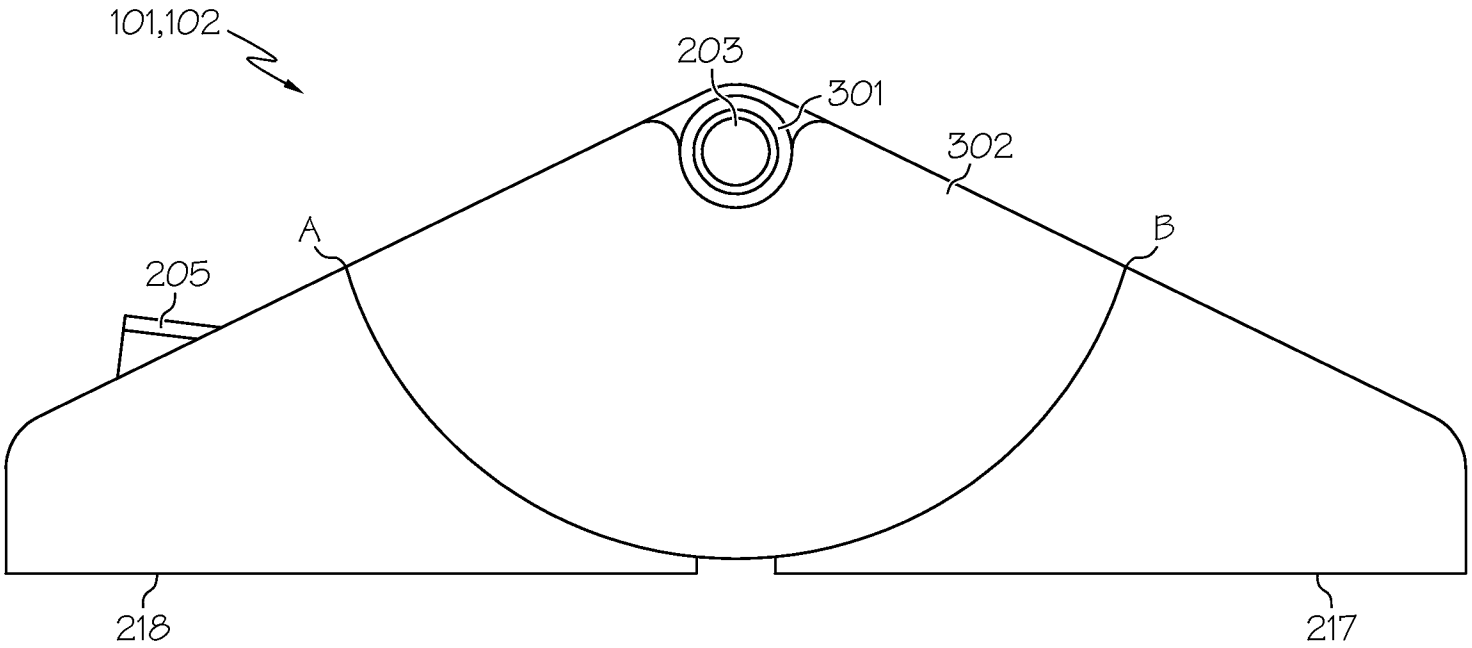
FIG. 3 illustrates an external view of the click-clack mechanism used to convert the sofa to different positions in accordance with an embodiment of the present invention.
Figure 4:
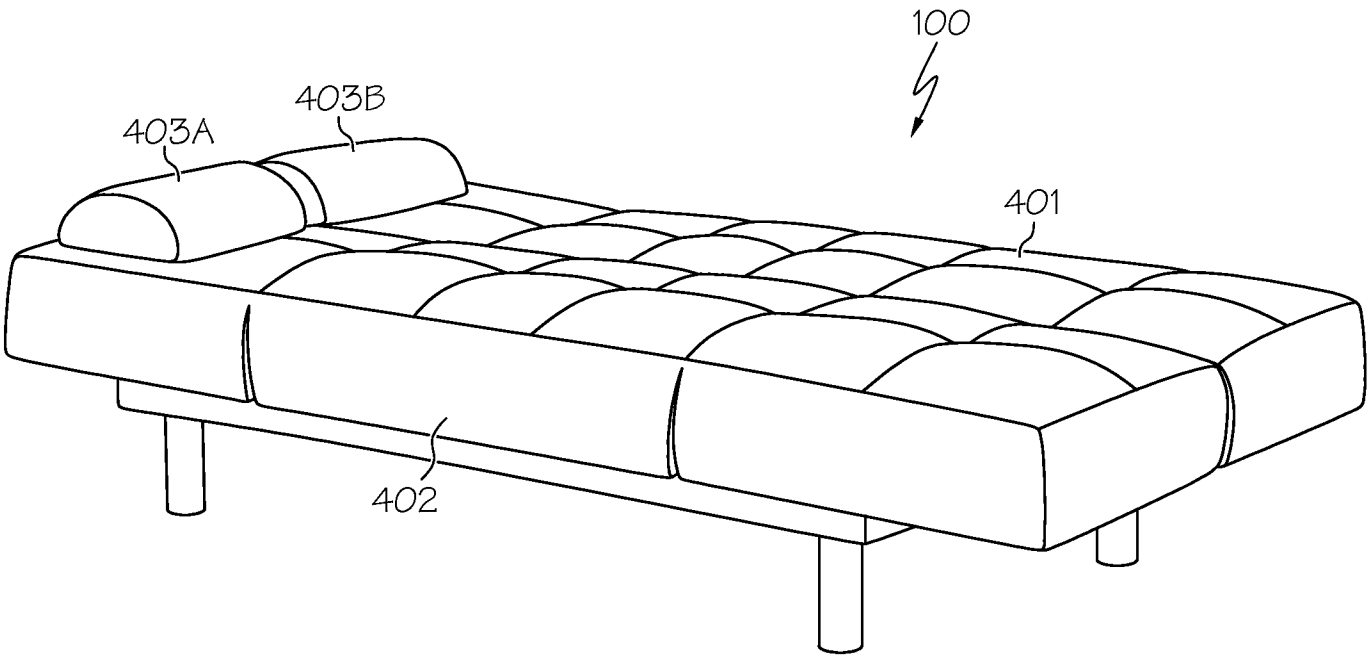
FIG. 4 illustrates the sofa being in the bed position in accordance with an embodiment of the present invention.
Figure 5:
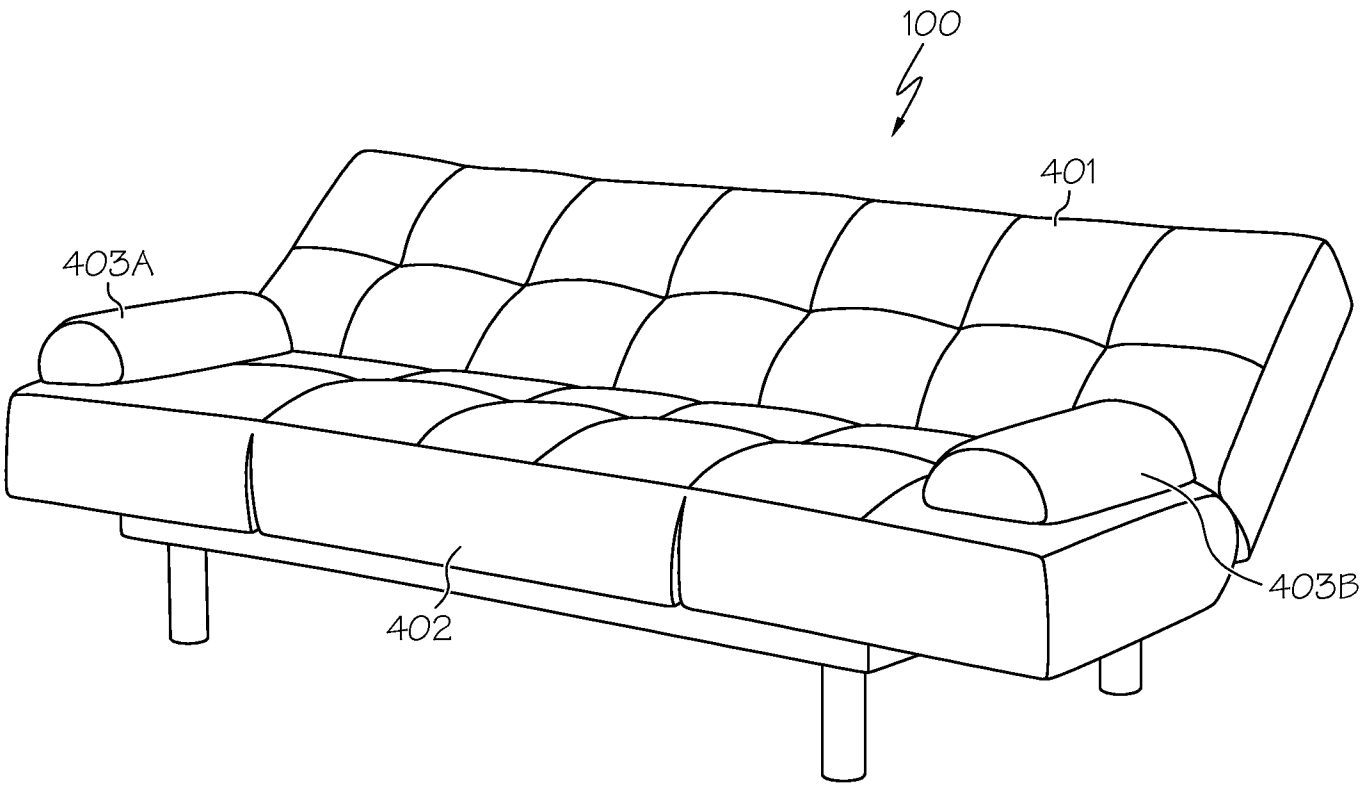
FIG. 5 illustrates the sofa being in the lounge position in accordance with an embodiment of the present invention.
Figure 6:
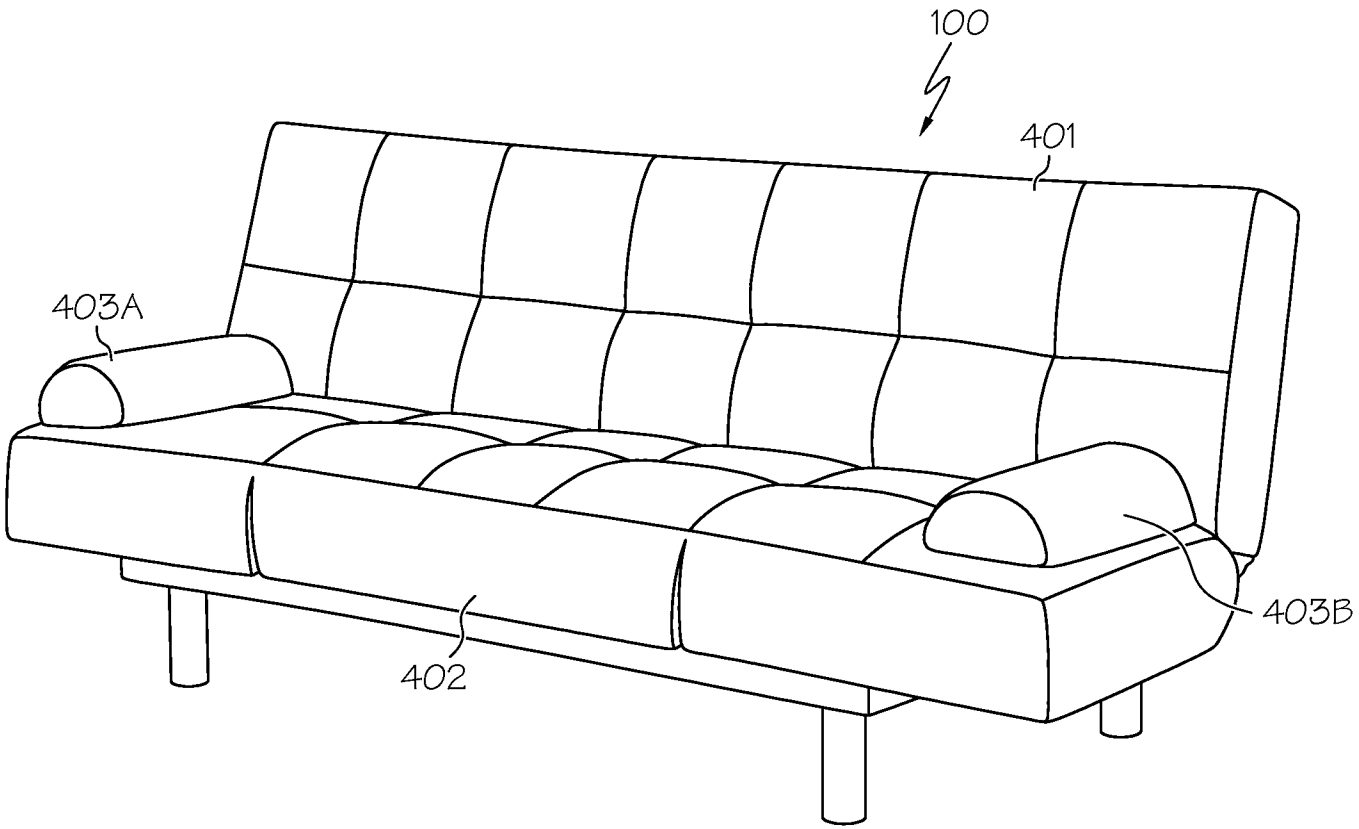
FIG. 6 illustrates the sofa being in the sofa position in accordance with an embodiment of the present invention.
Figure 7:
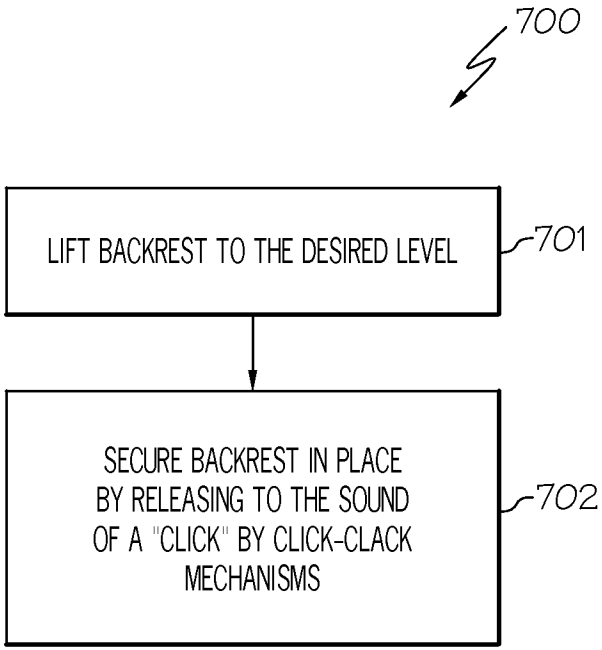
FIG. 7 is a flowchart of a method for converting the sofa from the bed position to either the lounge or sofa position in accordance with an embodiment of the present invention.
Figure 8:
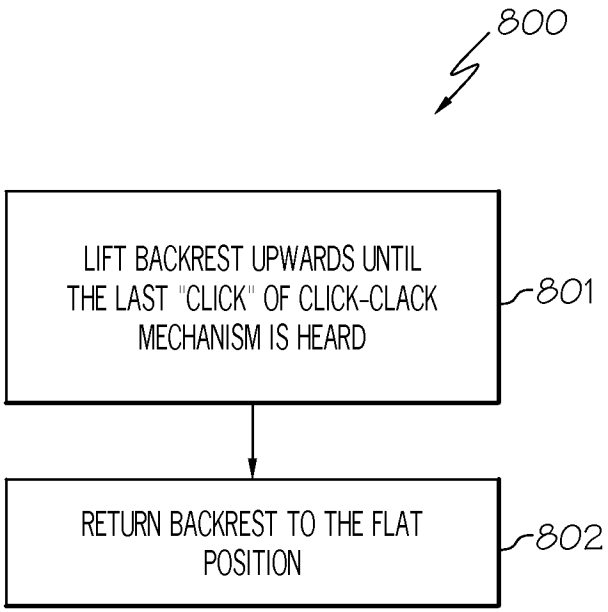
FIG. 8 is a flowchart of a method for converting the sofa from the sofa or lounge position to the bed position in accordance with an embodiment of the present invention.
Figure 9:
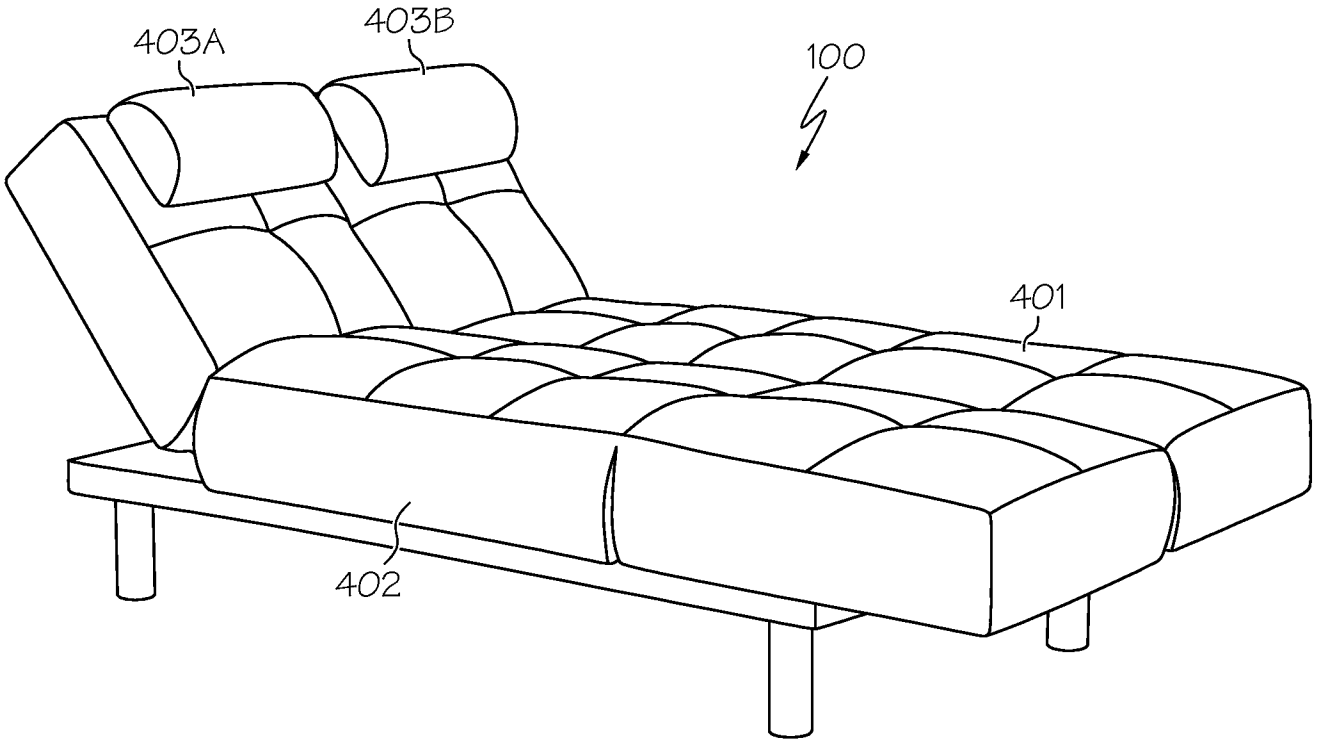
FIG. 9 illustrates the sofa being in one of the chaise positions in accordance with an embodiment of the present invention.
Figure 10:
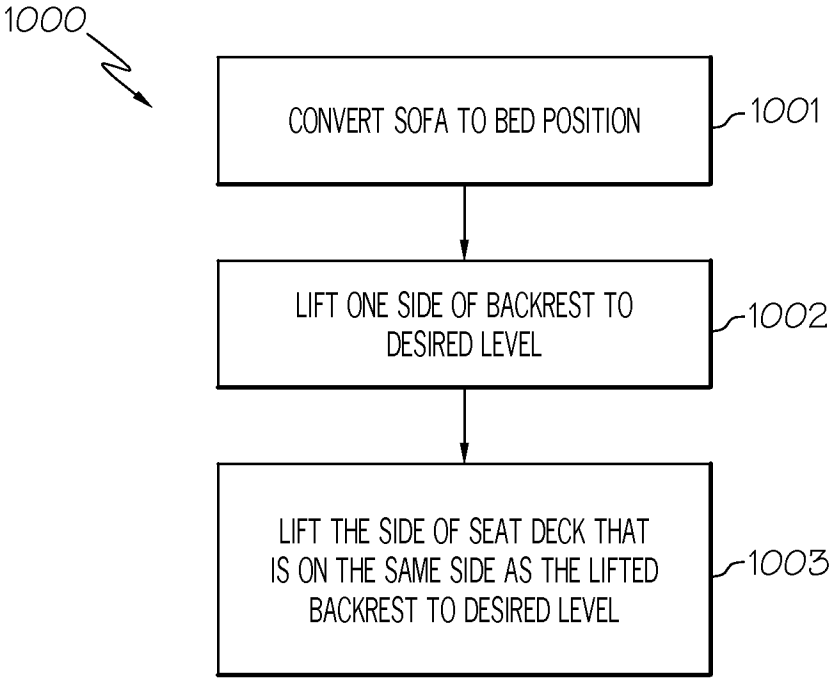
FIG. 10 is a method for converting the sofa to the chaise position shown in FIG. 9 in accordance with an embodiment of the present invention.
Figure 11:
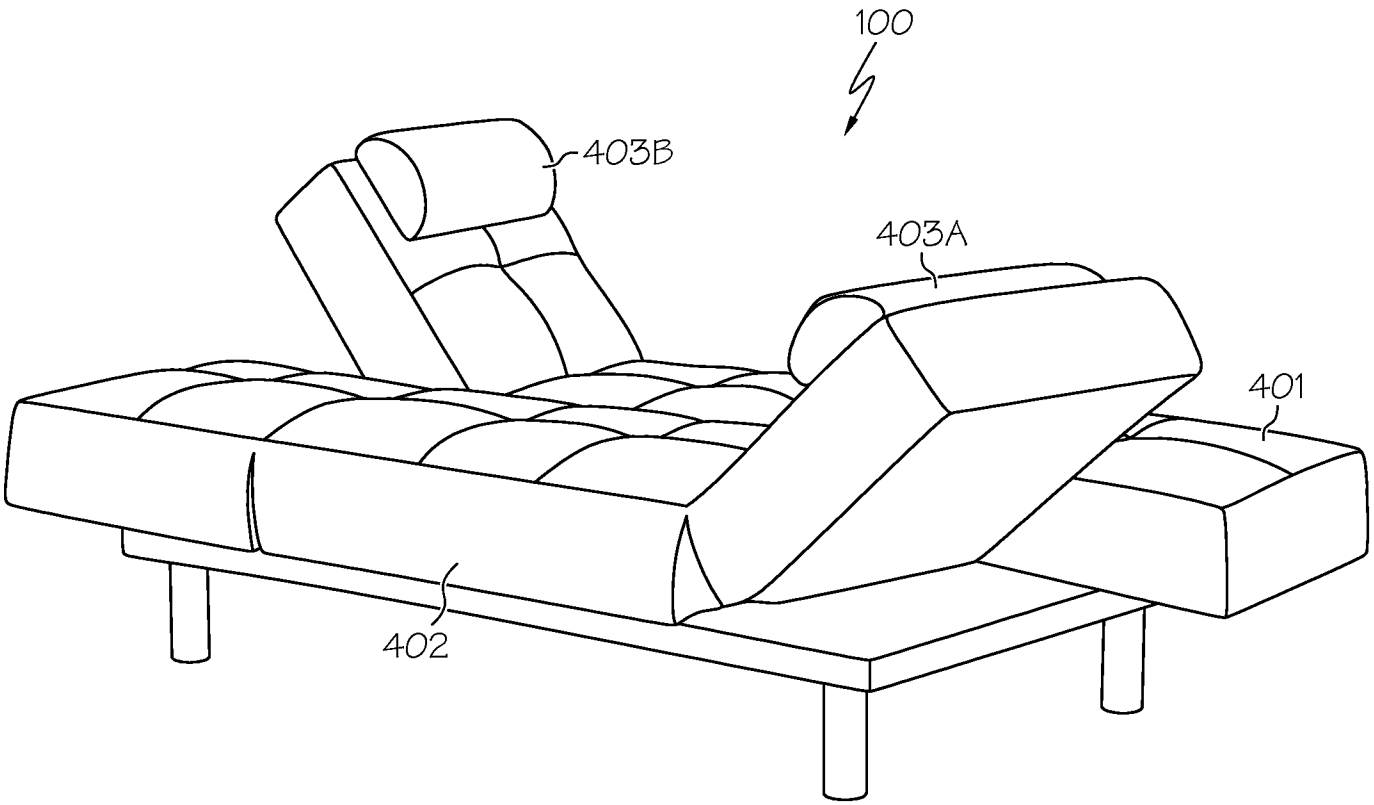
FIG. 11 illustrates the sofa being in an alternative chaise position in accordance with an embodiment of the present invention.
Figure 12:
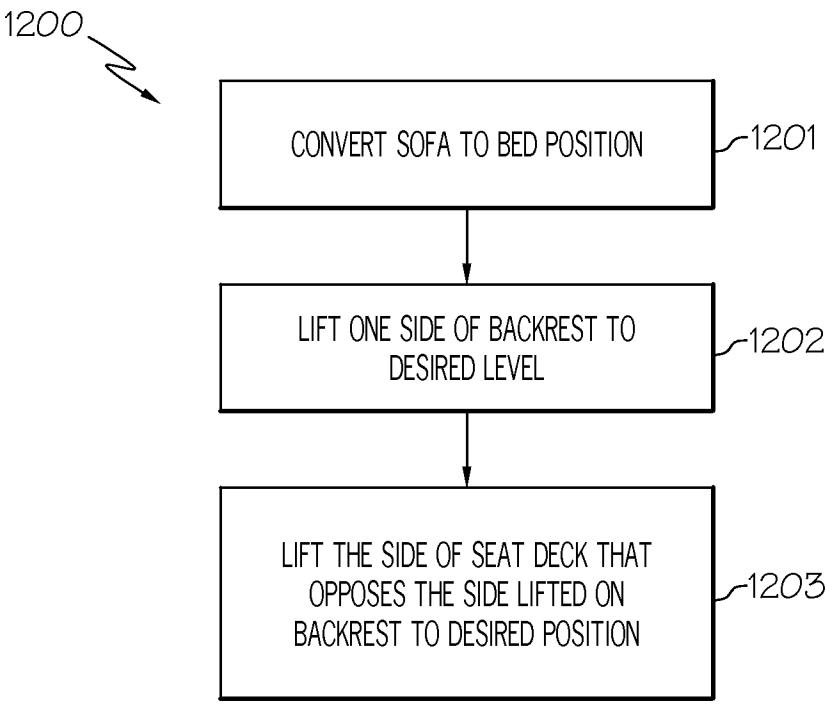
FIG. 12 is a method for converting the sofa to the chaise position shown in FIG. 11 in accordance with an embodiment of the present invention.

The principles of the present invention provide a sofa convertible that can be converted into various positions, including a chaise position, with individual chaises facing one another thereby allowing two individuals facing one another in opposite directions to converse with one another while at the same time stretch out their legs and relax as discussed below in connection with FIGS. 1-12. FIG. 1 illustrates the positioning of the hinges, referred to herein as "click-clack" mechanisms, that are used to transition the sofa from one position to another. FIG. 2 is an elevation view of a click-clack mechanism used to convert the sofa to different positions. FIG. 3 illustrates an external view of the sofa hinge. FIG. 4 illustrates the sofa being in the bed position. FIG. 5 illustrates the sofa being in the lounge position. FIG. 6 illustrates the sofa being in the sofa position. FIG. 7 is a flowchart of a method for converting the sofa from the bed position to either the lounge or sofa position. FIG. 8 is a flowchart of a method for converting the sofa from the sofa or lounge position to the bed position. FIG. 9 illustrates the sofa being in one of the chaise positions. FIG. 10 is a method for converting the sofa to the chaise position shown in FIG. 9. FIG. 11 illustrates the sofa being in an alternative chaise position. FIG. 12 is a method for converting the sofa to the chaise position shown in FIG. 11.

Referring now to the Figures in detail, FIG. 1 illustrates the various positions of hinges 101A-101B, 102A-102H, referred to herein as "click-clack" mechanisms, that are placed throughout sofa 100 at strategic locations to enable sofa 100 to be converted into various positions as described herein. In one embodiment, click-clack mechanisms of two sizes are used in converting sofa 100 to various positions as described herein. Clock-clack mechanisms 101A-101B are larger in size than click-clack mechanisms 102A-102H. In one embodiment, click-clack mechanisms 101A-101B are used for the sofa, lounge and bed functions as discussed further below; whereas, click-clack mechanisms 102A-102H are used for the chaise functions as discussed further below. Click-clack mechanisms 101A-101B may collectively or individually be referred to as click-clack mechanisms 101 or click-clack mechanism 101, respectively. Furthermore, click-clack mechanism 102A-102H may collectively or individually be referred to as click-clack mechanisms 102 or click-clack mechanism 102, respectively. In one embodiment, click-clack mechanism 101 has the same functionality as click-clack mechanism 102 but is only larger in size. While FIG. 1 illustrates two click-clack mechanisms 101 and eight click-clack mechanisms 102, embodiments of the present invention are not limited to such a configuration.

In one embodiment, click-clack mechanisms 102 are configured to elevate the sides of backrest and seat deck (discussed further below) to various levels (e.g., 20 degrees, 45 degrees). In this manner, sofa 100 may be converted to a chaise position as discussed further below.

A description of an embodiment of an elevation view of click-clack mechanisms 101/102 is provided below.

Referring to FIG. 2, FIG. 2 is an elevation view of a sofa hinge 101, 102 in accordance with an embodiment of the preset invention. Sofa hinge 101, 102 includes brackets 201, 202 which are rotatably connected together via a bolt 203. Bracket 202 further includes a semi-circular portion 204 which covers a portion of lever 205 (from an external perspective as shown in FIG. 3) during the various positions (e.g., lounge, sofa, sofa bed, chaise) of the sofa.

Sofa hinge 101, 102 further includes lever 205 which is connected to bracket 201 via a lever latch 206. In particular, lever latch 206 is bolted to lever 205 at one end of lever 205 at bolt 207. Lever latch 206 may be bolted to bracket 201 via bolts 208, 209.

Lever 205 is connected to bracket 202 via a lever latch 210. Lever latch 210 may be bolted to bracket 202 via bolts 211, 212. Furthermore, lever latch 210 includes a pin 213 used to select one of the notches 214 of lever 205 to select a position of the sofa. As pin 213 selects a particular notch 214 of lever 205, a "clicking" sound is heard which provides an indication to the operator that a new position of the sofa (e.g., lounge, sofa, sofa bed, chaise) has been established.

Additionally, sofa hinge 101, 102 may include a spring 215 connected to an end of lever 205 where spring 215 is bolted to bracket 201 via bolt 216.

In one embodiment for hinge 101, the distance of bracket 201 from the end identified as "A" in FIG. 2 to bolt 213 is about 5½ inches in length. In one embodiment for hinge 101, bracket 201 includes a flap 217 extending from the end labeled as "A" in FIG. 2 to the end labeled as "B" in FIG. 2. In one embodiment for hinge 101, the distance of flap 217 from end A to end B is about 4¾ inches in length.

In one embodiment for hinge 101, the distance of lever 205 from bolt 207 to the opposite end of lever 205 is about 5 inches in length.

In one embodiment for hinge 101, the distance of bracket 202 from the end identified as "C" in FIG. 2 to bolt 213 is about 5½ inches in length. In one embodiment for hinge 101, bracket 202 includes a flap 218 extending from the end labeled as "C" in FIG. 2 to the end labeled as "D" in FIG. 2. In one embodiment for hinge 101, the distance of flap 218 from end C to end D is about 4¾ inches in length.

A description of the external view of sofa hinge 101, 102 is provided below in connection with FIG. 3.

Referring to FIG. 3, in conjunction with FIG. 2, FIG. 3 illustrates an external view of sofa hinge 101, 102 in accordance with an embodiment of the present invention. Components of sofa hinge 101, 102 that are shown on both the internal (FIG. 2) and external (FIG. 3) views have the same identification number.

As illustrated in FIG. 3, sofa hinge 101, 102 includes a cover plate 301 that includes a semi-circular portion 302. Cover plate 301 is rotatably connected to sofa hinge 101, 102 via bolt 203. In one embodiment, cover plate 301 covers at least a portion of semi-circular portion 204 of bracket 202 in various positions of the sofa. By having cover plate 301 conceal the gear mechanism of sofa hinge 101, 102, the risk of injury to the operator's fingers is substantially reduced.

In one embodiment, cover plate 301 is adjacent to semi-circular portion 204 of bracket 202. In one embodiment for hinge 101, the horizontal distance between the end labeled as "A" in FIG. 3 to the end labeled as "B" in FIG. 3 is about 5½ inches in length.

As discussed above, sofa 100 has the ability to be converted into various positions, such as the sofa position, the lounge position, the bed position and two different chaise positions, due to the strategic locations of click-clack mechanisms 101, 102. FIG. 4 illustrates sofa 100 in the bed position in accordance with an embodiment of the present invention. Referring to FIG. 4, sofa 100 includes a backrest 401 and a seat deck 402. Sofa 100 may further include one or more headrests 403A-403B which may be placed at either end of sofa. Headrests 403A-403B may collectively or individually be referred to as headrests 403 or headrest 403, respectively.

In the following Figures of sofa 100 demonstrating the different positions of sofa 100, the same elements of sofa 100 of FIG. 4 are identified with the same element numbers as used in FIG. 4.

FIG. 5 illustrates sofa 100 in the lounge position in accordance with an embodiment of the present invention. Referring to FIG. 5, sofa 100 includes a backrest 401 and a seat deck 402. Sofa 100 may further include one or more headrests 403 which may be placed at either end of sofa.

FIG. 6 illustrates sofa 100 in the sofa position in accordance with an embodiment of the present invention. Referring to FIG. 6, sofa 100 includes a backrest 401 and a seat deck 402. Sofa 100 may further include one or more headrests 403 which may be placed at either end of sofa.

A method for converting sofa 100 from the bed position to either the lounge or sofa position is discussed below in connection with FIG. 7.

FIG. 7 is a method 700 for converting sofa 100 from the bed position to either the lounge or sofa position in accordance with an embodiment of the present invention.

Referring to FIG. 7, in conjunction with FIGS. 1 and 4-6, in step 701, a user of sofa 100, such as by standing at the side of sofa 100, lifts backrest 401 to the desired level (highest level for sofa position and middle level for lounge position). In step 702, the user of sofa 100 secures backrest 401 in place by releasing to the sound of a "click" by click-clack mechanisms 101.

In some implementations, method 700 may include other and/or additional steps that, for clarity, are not depicted. Further, in some implementations, method 700 may be executed in a different order presented and that the order presented in the discussion of FIG. 7 is illustrative. Additionally, in some implementations, certain steps in method 700 may be executed in a substantially simultaneous manner or may be omitted.

A method for converting sofa 100 from the sofa or lounge position to the bed position is discussed below in connection with FIG. 8.

Referring to FIG. 8, in conjunction with FIGS. 1 and 4-6, in step 801, a user of sofa 100, such as by standing at the side of sofa 100, lifts backrest 401 upwards until the last "click" of click-clack mechanisms 101 is heard which unlocks the mechanism. In step 802, the user of sofa 100 returns backrest 401 to the flat position.

In some implementations, method 800 may include other and/or additional steps that, for clarity, are not depicted. Further, in some implementations, method 800 may be executed in a different order presented and that the order presented in the discussion of FIG. 8 is illustrative. Additionally, in some implementations, certain steps in method 800 may be executed in a substantially simultaneous manner or may be omitted.

As discussed above, sofa 100 may be converted into a chaise position. One such chaise position is shown in FIG. 9. FIG. 9 illustrates sofa 100 in the chaise position in accordance with an embodiment of the present invention.

Figure 13:
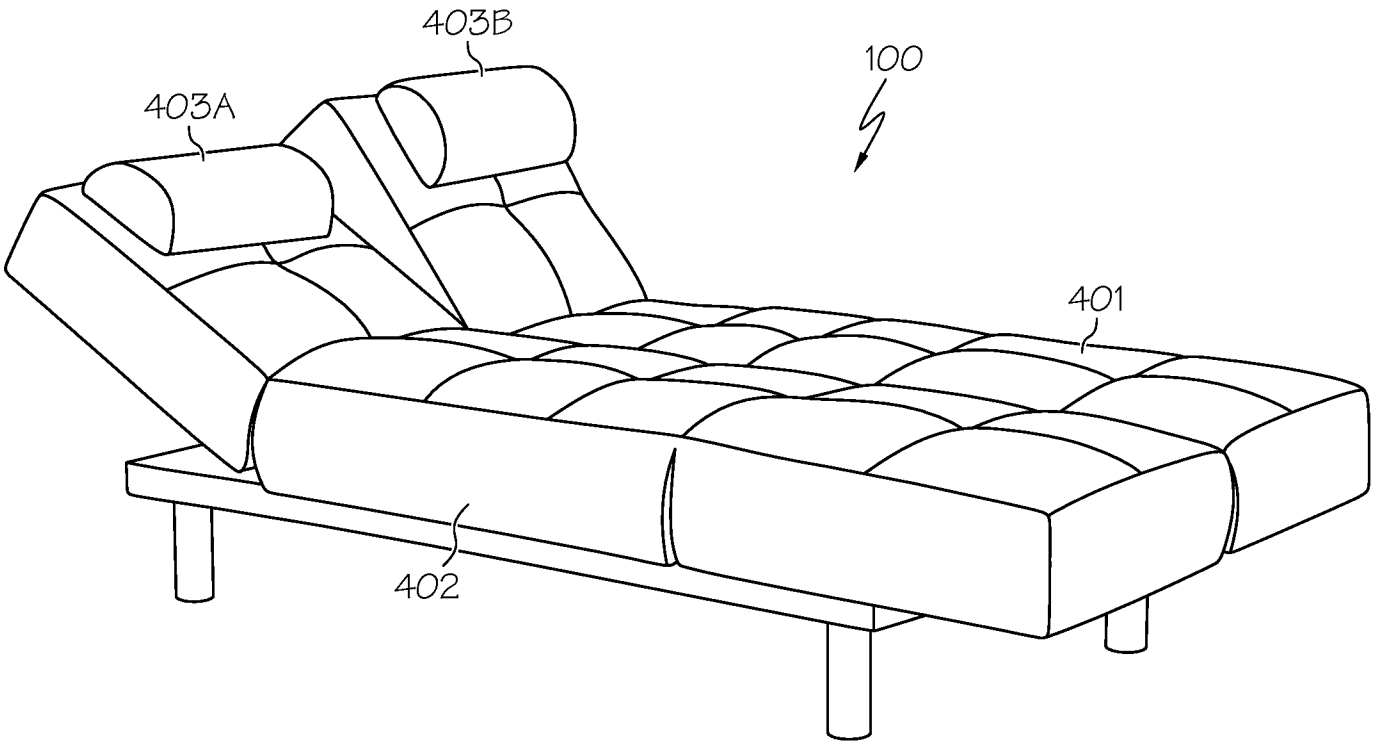
FIG. 13 illustrates the sofa being in an alternative chaise position in accordance with an embodiment of the present invention.

Referring to FIG. 9, sofa 100 includes a backrest 401 and a seat deck 402. Each side of backrest 401 and seat deck 402 may be raised to a variable level (e.g., 20 degrees, 45 degrees, at horizontal level). That is, each side of backrest 401 and seat deck 402 may have the capability of being in one of the variable levels, including different levels. In particular, while FIG. 9 illustrates the sides of backrest 401 and seat deck 402 being raised at the same level, each side may be raised to a different level. For example, the sides of backrest 401 and seat deck 402, which have headrests 403B and 403A, are raised to an approximate 45 degree angle, while the opposite sides of backrest 401 and seat deck 402 are horizontal. In FIG. 13, the side of backrest 401 having headrest 403B is raised to an angle of approximately 45 degrees, the seat deck 402 which has headrest 403A is raised to an angle of approximately 20 degrees, and the opposite sides of backrest 401 and seat deck 402 are horizontal. Each side has such a capability due to click-clack mechanisms 102 being placed at strategic locations as shown in FIG. 1.

A method for converting sofa 100 to the chaise position shown in FIG. 9 is discussed below in connection with FIG. 10.

Referring to FIG. 10, in conjunction with FIGS. 1 and 4-6 and 9, in step 1001, a user of sofa 100 ensures that sofa 100 is in the bed position. In step 1002, a user of sofa 100, such as by facing sofa 100, lifts one side of backrest 401 to the desired level (e.g., 20 degrees). In step 1003, a user of sofa 100, such as by facing sofa 100, lifts the side of seat deck 402 that is on the same side as the side lifted on backrest 401 to the desired level, which may be the same or different level as the level of backrest 401.

In some implementations, method 1000 may include other and/or additional steps that, for clarity, are not depicted. Further, in some implementations, method 1000 may be executed in a different order presented (e.g., step 1003 could occur prior to step 1002) and that the order presented in the discussion of FIG. 10 is illustrative. Additionally, in some implementations, certain steps in method 1000 may be executed in a substantially simultaneous manner or may be omitted.

An alternative embodiment to the chaise position shown in FIG. 9 is shown in FIG. 11. FIG. 11 illustrates sofa 100 in an alternative chaise position in accordance with an embodiment of the present invention.

Referring to FIG. 11, sofa 100 includes a backrest 401 and a seat deck 402. Each side of backrest 401 and seat deck 402 may be raised to a variable level (e.g., 20 degrees, 45 degrees, at horizontal level). That is, each side of backrest 401 and seat deck 402 may have the capability of being in one of the variable levels, including different levels. Each side has such a capability due to click-clack mechanisms 102 being placed at strategic locations as shown in FIG. 1.

As shown in FIG. 11, the opposite ends of backrest 401 and seat deck 402 are raised at the appropriate level thereby providing two individual chaises facing one another.

A method for converting sofa 100 to the chaise position shown in FIG. 11 is discussed below in connection with FIG. 12.

Referring to FIG. 12, in conjunction with FIGS. 1 and 4-6 and 11, in step 1201, a user of sofa 100 ensures that sofa 100 is in the bed position. In step 1202, a user of sofa 100, such as by facing sofa 100, lifts one side of backrest 401 to the desired level (e.g., 20 degrees). In step 1203, a user of sofa 100, such as by facing sofa 100, lifts the side of seat deck 402 that opposes the side lifted on backrest 401 to the desired level, which may be the same or different level as the level of backrest 401.

In some implementations, method 1200 may include other and/or additional steps that, for clarity, are not depicted. Further, in some implementations, method 1200 may be executed in a different order presented (e.g., step 1203 could occur prior to step 1202) and that the order presented in the discussion of FIG. 12 is illustrative. Additionally, in some implementations, certain steps in method 1200 may be executed in a substantially simultaneous manner or may be omitted.

Although the sofa is described in connection with several embodiments, it is not intended to be limited to the specific forms set forth herein, but on the contrary, it is intended to cover such alternatives, modifications and equivalents, as can be reasonably included within the spirit and scope of the invention as defined by the appended claims.

The invention claimed is:

1. A sofa, comprising:

a seat deck;

a backrest;

a plurality of a first type of click-clack mechanisms placed between said seat deck and said backrest, wherein said first type of click-clack mechanisms are configured to convert said sofa to one of a lounge position and a bed position;

a plurality of a second type of click-clack mechanisms placed throughout said seat deck and said backrest, wherein said second type of click-clack mechanism are configured to convert said sofa to one of two possible chaise positions, wherein said second type of click-clack mechanisms enable sides of said seat deck and said backrest to be raised to various levels; and wherein said one of two possible chaise positions comprises a first side of said seat deck and a first side of said backrest being raised at a same level, wherein said first side of said seat deck and said first side of said backrest are on a same side.

2. The sofa as recited in claim 1, wherein said same level is at 20 degrees with respect to a horizontal level.

3. The sofa as recited in claim 1, wherein said same level is at 45 degrees with respect to a horizontal level.

4. The sofa as recited in claim 1, wherein said second of said two possible chaise positions comprises a first side of said seat deck being raised at a first level and a first side of said backrest being raised at a second level, wherein said first level and said second level are different levels, wherein said first side of said seat deck and said first side of said backrest are on a same side.

5. The sofa as recited in claim 1, wherein said first or second of said two possible chaise positions comprises a first side of said seat deck and a first side of said backrest being raised at a same level, wherein said first side of said seat deck and said first side of said backrest are opposing sides.

6. The sofa as recited in claim 5, wherein said same level is at 20 degrees with respect to a horizontal level.

7. The sofa as recited in claim 5, wherein said same level is at 45 degrees with respect to a horizontal level.

8. The sofa as recited in claim 1, wherein said first or second of said two possible chaise positions comprises a first side of said seat deck being raised at a first level and a first side of said backrest being raised at a second level, wherein said first level and said second level are different levels, wherein said first side of said seat deck and said first side of said backrest are opposing sides.

9. The sofa as recited in claim 1, wherein each of said plurality of first type of click-clack mechanisms is functionally equivalent to each of said plurality of second type of click-clack mechanisms, wherein each of said plurality of first type of click-clack mechanisms is larger in size than each of said plurality of second type of click-clack mechanisms.

10. The sofa as recited in claim 1, wherein said second type of click-clack mechanisms enable said sides of said seat deck and said backrest to be raised at 20 degrees and 45 degrees with respect to a horizontal level.

11. A sofa, comprising:

a seat deck;

a backrest;

a plurality of a first click-clack mechanism placed between said seat deck and said backrest, wherein said first click-clack mechanism is configured to convert said sofa to one of a lounge position and a bed position;

a plurality of a second click-clack mechanism placed throughout said seat deck and said backrest, wherein said second click-clack mechanism is configured to convert said sofa to multiple chaise positions, wherein said second click-clack mechanism enables a first and second side of said seat deck and said backrest to be raised to various levels; and wherein said multiple chaise positions include said first side of said seat deck and said backrest being at a same level or at different levels, and said second side of said seat deck and said backrest being at a same level or at different levels.

12. The sofa as recited in claim 11, wherein each of said plurality of said first click-clack mechanisms is functionally equivalent to each of said plurality of said second click-clack mechanisms, and wherein each of said plurality of said first click-clack mechanisms is larger in size than each of said plurality of said click-clack mechanisms.

13. A sofa, comprising:

a seat deck;

a backrest;

a plurality of a first click-clack mechanism placed between said seat deck and said backrest, wherein said first click-clack mechanism is configured to convert said sofa to one of a lounge position and a bed position;

a plurality of a second click-clack mechanism placed throughout said seat deck and said backrest, wherein said second click-clack mechanism is configured to convert said sofa to multiple chaise positions, wherein said second click-clack mechanism enables a first and second side of said seat deck and said backrest to be raised to various levels; and wherein at least a portion of each of said plurality of said first click-clack mechanisms and at least a portion of each of said plurality of said second click-clack mechanisms share a same horizontal plane, and at least a portion of at least one said first click-clack mechanism and at least a portion of at least one said second click-clack mechanism share a same vertical plane.

14. A sofa, comprising:

a seat deck;

a backrest;

a plurality of a first click-clack mechanism placed between said seat deck and said backrest, wherein said first click-clack mechanism is configured to convert said sofa to one of a lounge position and a bed position;

a plurality of a second click-clack mechanism placed throughout said seat deck and said backrest, wherein said second click-clack mechanism is configured to convert said sofa to multiple chaise positions, wherein said second click-clack mechanism enables a first and second side of said seat deck and said backrest to be raised to various levels; and wherein said second type of click-clack mechanisms rotate around the same axis when either said first or said second side of said seat deck and said backrest are raised.

* * * * *